United States Patent [19]

Ripple

[11] 4,177,873

[45] * Dec. 11, 1979

[54] LOUDSPEAKER EQUIPMENT

[76] Inventor: Warren Ripple, 2839 Sterling La., Sarasota, Fla. 33581

[ * ] Notice: The portion of the term of this patent subsequent to May 13, 1992, has been disclaimed.

[21] Appl. No.: 790,485

[22] Filed: Apr. 25, 1977

Related U.S. Application Data

[63] Continuation of Ser. No. 615,364, Sep. 22, 1975, abandoned.

[51] Int. Cl.[2] ..... H04R 1/28; G10K 13/00

[52] U.S. Cl. ..... 181/148; 181/199

[58] Field of Search ..... 181/141, 144–156, 181/199

[56] References Cited

U.S. PATENT DOCUMENTS

| | | | |
|---|---|---|---|
| 2,036,832 | 4/1936 | Scheldorf | 181/145 |
| 2,476,572 | 7/1949 | Wenzel | 181/148 |
| 2,880,817 | 4/1959 | Burns et al. | 181/156 |
| 3,090,461 | 5/1963 | Gray | 181/148 |
| 3,113,633 | 12/1963 | Eberhardt et al. | 181/145 |
| 3,151,699 | 10/1964 | Peavey | 181/156 |
| 3,746,125 | 7/1973 | Hammes | 181/199 |
| 3,882,962 | 5/1975 | Ripple | 181/148 |
| 3,941,207 | 3/1976 | Croup | 181/199 |

*Primary Examiner*—Stephen J. Tomsky
*Attorney, Agent, or Firm*—Kenneth P. Synnestvedt

[57] ABSTRACT

Loudspeaker equipment is disclosed of a type comprising a speaker and a speaker enclosure, the enclosure having intercommunicating front and rear compartments, the front compartment being of larger volume than the rear compartment, and the compartments being defined by walls formed of sheet material and being substantially imperforate, except for a speaker opening in one wall thereof.

7 Claims, 6 Drawing Figures

LOUDSPEAKER EQUIPMENT

This is a continuation, of application Ser. No. 615,364, filed Sept. 22, 1975 now abandoned.

BACKGROUND AND STATEMENT OF OBJECTS

The present invention is concerned with speaker equipment, particularly equipment comprising a speaker of the well known cone type, and a speaker enclosure of novel configuration and construction.

Certain prior art speaker equipment has provided for the mounting of a speaker upon a baffle having a speaker opening, and frequently such a baffle is arranged in a relatively large cabinet having a substantial volume behind the speaker. In other known speaker equipment, the speaker is mounted in a chamber of relatively small volume but having an opening so that the speaker is in effect exposed not only at the front side of the speaker cone but also from the back side thereof. In general, in various forms of such speakers, the cabinetry has been of generally rectangular shape and also has been constructed of relatively heavy or thick baffle and wall boards, it being intended that the cabinetry or enclosure should be of sufficient thickness and mass to preclude any substantial vibration.

The speakers according to the present invention are distinguished from various prior art speakers by several important distinguishing characteristics. Thus, speaker equipment constructed according the present invention comprises a speaker mounted in a cabinet which not only has a chamber of relatively small total volume but which is also characterized by the provision of intercommunicating front and rear chamber compartments, the front compartment having a panel with an opening through which the speaker is exposed and being of relatively large volume, as compared with the rear compartment, which latter preferably is formed by a thin but wide "tail" communicating with and projecting rearwardly from the front compartment.

In addition, the speaker equipment of the present invention utilizes an enclosure which is formed of relatively thin sheet material, for instance plywood of the order of ⅛" in thickness, the speaker enclosure being substantially imperforate, except for the opening through which the speaker is exposed.

By the use of a speaker enclosure as described just above, the enclosure itself extensively participates in the sound generation, particularly at the lower frequencies of the audio spectrum.

Moreover by the employment of a front compartment of relatively large volume as compared with the volume of the rear compartment and by forming the rear compartment in the shape of a wide and thin "tail", points of resonance are avoided, and substantially uniform sound generation is developed throughout the range in which the speaker is effective.

Still further the general configuration of the speaker enclosure provided by the invention adapts the speaker equipment to use in a variety of positions and situations, including automobiles, as well as indoors and outdoors.

BRIEF DESCRIPTION OF THE DRAWINGS

How the foregoing objects and advantages are attained will appear more fully from the following description referring to the accompanying drawings in which.

DETAILED DESCRIPTION

Figure 1:
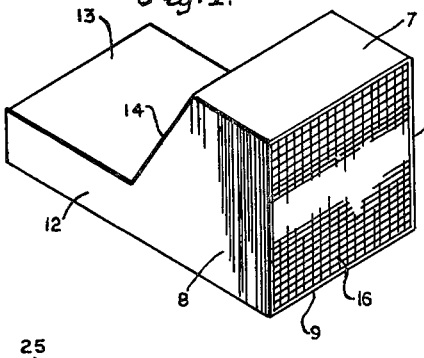
FIG. 1 is an isometric view of one form of speaker enclosure according to the present invention.
Figure 2:
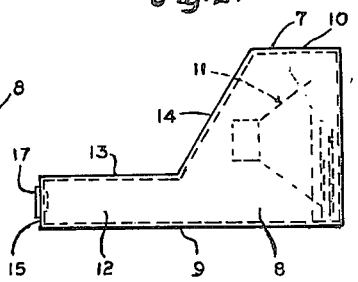
FIG. 2 is a side elevational view, with a portion broken away and shown in section, and indicating somewhat diagrammatically the position of a speaker within the enclosure.
Figure 3:
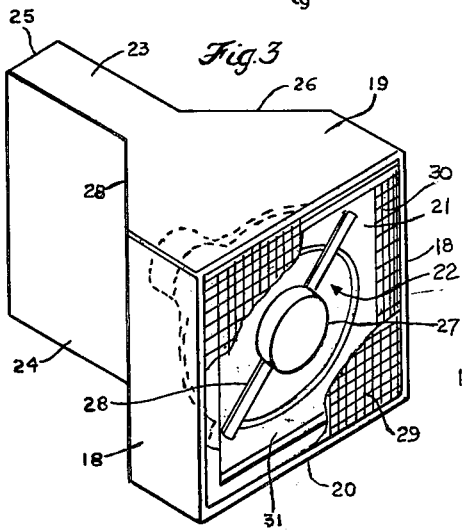
FIG. 3 is an isometric view of a modified form of speaker enclosure, with a portion of the front grill broken out to disclose the speaker mounting.
Figure 4:
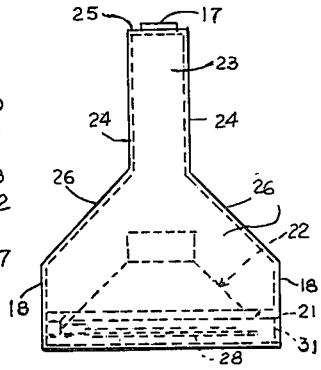
FIG. 4 is a top plan view of the speaker shown in FIG. 3.
Figure 5:
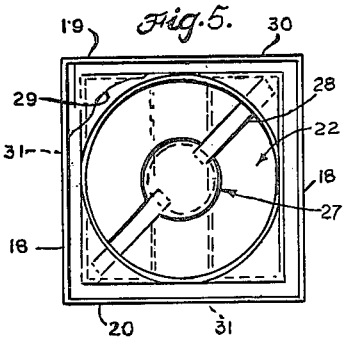
FIG. 5 is a front elevational view of the speakers of 3 and 4.
Figure 6:
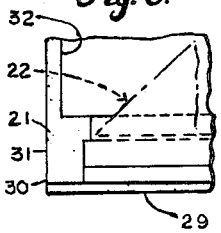
FIG. 6 is a somewhat enlarged sectional detailed view of certain of the mounting parts of the speaker employed in the arrangement of FIGS. 3, 4 and 5.

Referring first to the embodiment shown in FIGS. 1 and 2, it will be seen that the speaker enclosure there shown incorporates side walls such as illustrated at 7, 8—8 and 9 which define the sides of a generally rectangular front compartment in which the front wall 10 is mounted. This front wall is rectangular or square to fit within the walls 7, 8—8 and 9, and has a circular opening for cooperation with the speaker which is diagrammatically indicated at 11 in FIG. 2.

The lateral side walls 8—8 are of identical shape, each having a rearward extension 12 serving to define one wall of the rear compartment of the speaker enclosure. The bottom wall 9 comprises a rectangular wall element, the forward portion of which defines the bottom of the front compartment and the rearward portion of which defines the bottom of the rear compartment. The rear compartment also has a wall element 13 defining the top of the rear compartment. An inclined wall 14 joins the top wall 7 of the front compartment and the top wall 13 of the rear compartment and in effect constitutes an element defining the juncture of the front and rear compartments. A wall element 15 at the rear of the rear compartment completes the enclosure. An appropriate screen or cloth 16 covers the speaker at the front side of the front compartment.

Although wiring for delivering the audio signals may be introduced in any manner, a plug 17 in the rear wall 15 conveniently serves that purpose.

The speaker enclosure described above and shown in FIGS. 1 and 2 is advantageously formed of sheet material such as plywood, and in the preferred construction, this sheet material is quite thin, for instance of the order of ⅛", the walls being bonded to each other at the meeting edges by any appropriate adhesive and preferably without extensive or highly rigid reinforcement strips.

The configuration of the speaker as described above and particularly the provision of the two interconnected compartments substantially differing from each other in volume, with the rear compartment in the form of what might be termed a "tail" of wide and thin shape projecting rearwardly from the front compartment, provides an enclosure which extensively participates in the sound generation, without producing sharply peaked resonant points.

The speaker of FIGS. 1 and 2, with the rear compartment in the form of a tail having a bottom wall in a common plane with the front compartment and also having side walls formed by rearward extensions 12 of the side walls 8 of the front compartment, results in a configuration which is readily fabricated and which is also conveniently shaped from the standpoint of certain special uses such as in automobiles, in which the tail may be accommodated in a relatively small space, for instance beneath a car seat.

Turning now to the embodiment shown in FIGS. 3 to 6 inclusive, it will be seen that the front compartment of the speaker there shown is formed by wall elements 18—18, and top and bottom elements 19 and 20, which are counterparts of each other. The face plate or speaker mounting wall 21 is positioned near the front of the front compartment and has a central aperture for cooperation with the cone speaker diagrammatically indicated at 22. The top and bottom walls 19 and 20 are each provided with a rearward extension, one of which appears at 23, for defining the top and bottom of the rear compartment of this embodiment. Side walls 24—24 are also provided for the rear compartment, as is a rear end wall 25. In this embodiment the rear compartment is in the form of a tail projecting rearwardly from the front compartment in the mid region thereof, and each pair of side walls 18 and 24 at the sides of the rear compartment are joined by inclined walls 26—26. It will thus be seen that in this embodiment the rear compartment is also in the form of a "tail" but which (with the speaker positioned as illustrate in FIG. 3) has its large dimension lying in a vertical plane and extended rearwardly from the front compartment in that plane. Moreover as is shown, the rear compartment is of the same vertical dimension as the forward compartment, and the top and bottom of the rear compartment are defined by extensions 23 of the top and bottom walls 19 and 20 of the front compartment. As in the embodiment first decribed, this configuration facilitates fabrication because of the use of a common element for defining certain corresponding walls of the front and rear compartments.

The embodiment of FIGS. 3 to 6 is not only adapted for use with the cone type of speaker as indicated at 22, but may be employed also with a supplemental high frequency speaker, such as a cone or dome indicated diagrammatically at 27 which may be positioned and mounted generally centrally or coaxially with the cone speaker 22, as by the bridging support 28 mounted upon the face plate or front wall 21 and extended across the speaker 22.

To accommodate both speaker 22 and speaker 27 within the confines of the front compartment, it is desirable that the face plate 21 be inset from the front of the speaker enclosure. For the purpose of providing support for a grill or cover cloth 29, a frame 30 may be secured to the face plate 21, for instance by means of spacers 31.

As in the embodiment of FIGS. 1 and 2, the employment of FIGS. 3 to 6 may be provided with a connector plug 17 at the rear end.

It is contemplated that the speaker enclosure of FIGS. 3 to 6 also be formed of sheet material, as in the first embodiment, and the form of construction and assembly there described is also applicable to the second embodiment.

As above indicated it is preferred to form the walls of the speaker enclosure of relatively thin sheet material, for instance from 1/16" to ¼" in thickness. Preferably the sheet material comprises wood. Plywood of thickness of the order of ⅛" is well suited to the purpose.

It is also contemplated that some fibrous material, for instance fiber glass mat of low density be applied to the inside surfaces of the speaker enclosure walls. This is indicated in the fragmentary view of FIG. 6 at 32. The fibrous material may be adhesively secured to the inside surfaces, and advantageously this material comprises only a relatively thin layer averaging about ¼" to ½" in thickness. Such a thin fibrous layer assists in minimizing reflection of sound waves at the high frequency end of the spectrum, without resulting in impairment of low frequency radiation from the walls of the enclosure, and I have found that these factors assist in providing the desired participation of the enclosure itself in the radiation of sound.

Typical dimensions of speaker enclosures and of the compartments thereof are generally indicated by the relationship between the size of the speaker to the size of the enclosure, as shown in the drawings. Some variation of sizes is of course useable in accordance with the invention, but general proportions of the speaker enclosure may be determined from an example such as given just below.

Thus, assuming that the cone speaker 22 of FIGS. 3 to 6 inclusive is 10" in diameter, the face panel 21 is desirably about 12" by 12". In this example the depth of the front compartment behind the face panel 21 is of the order of 4" and the junction portion defined by the inclined walls 26—26 is of the order of 5", measured in a direction perpendicular to the front wall. The tail of the enclosure of this example would be of the order of 7" (extended rearwardly from the inclined walls 26—26) and the thickness of the "tail" would be about 3".

It will be understood that the dimensions referred to are given by way of example and not by way of limitation, but because of the relatively small size of the enclosure volume, the example will assist in establishing appropriate dimensions and proportions. For a smaller speaker cone, for instance an 8" speaker, proportionate reductions in the dimensions would be useable, and for a larger cone for instance, as 12" cone, proportionately larger dimensions would be useable.

It is a common characteristic of both forms of speaker enclosure illustrated and described herein that the enclosure walls define intercommunicating compartments, the front compartment being generally rectangular and having dimensions in directions paralleling the speaker mounting or front wall, which dimensions are greater than the dimensions or average dimension of the front compartment in a direction perpendicular to the front wall. In addition, in each form of speaker the rear compartment has one transverse dimension which is the same as the corresponding dimension of the front compartment but which has a much smaller dimension in the other transverse dimension. Also the geometry or configuration is such that the wide and thin rear (or "tail") compartment projects rearwardly from the front compartment either adjacent one side plane thereof (as in FIGS. 1 and 2), or in the mid region of the front compartment (as in FIGS. 3 to 6).

I claim:

1. Loudspeaker equipment comprising a speaker and a speaker enclosure, the enclosure having enclosure walls defining a speaker chamber having front and rear intercommunicating portions, the front portion having a front wall with an opening therein and with the speaker mounted thereon and exposed through the opening, the side walls of the front portion defining a generally rectangular cavity of greater dimensions in directions paralleling the front wall than the dimension of said cavity perpendicular to the front wall, and the rear portion having walls defining a generally rectangular cavity a first transverse dimension of which is the same as the corresponding dimension of the front cavity and the second transverse dimension of which is substantially smaller than the corresponding dimension of the front cavity, the enclosure walls being at least in large part formed of sheet material of thickness of the order of 1/16" to ¼" and the speaker enclosure being substantially completely imperforate except for the speaker opening, thereby providing loudspeaker equipment in which the walls of the speaker enclosure extensively participate in the sound generation.

2. Loudspeaker equipment as defined in claim 1 in which the side walls defining the second or smaller transverse dimension of the rear portion of the chamber are positioned to provide for rearward projection of the mean plane of the rear cavity from the central region of the front cavity.

3. Loudspeaker equipment comprising a speaker and a speaker enclosure, the enclosure having enclosure walls defining a speaker chamber having a front relatively large compartment and a rear relatively small compartment intercommunicating with the large compartment, the enclosure walls including a pair of duplicate walls of the same configuration and positioned in parallel spaced congruent relation to each other at opposite sides of the enclosure, each of said duplicate walls having interconnected relatively large and small portions lying in a common plane and respectively defining opposite sides of the intercommunicating front and rear compartments of the speaker chamber, additional enclosure walls completing the enclosure of the speaker chamber and including enclosure walls connected with the relatively small portions of said duplicate walls and defining the relatively small rear compartment of the chamber, and further including at least three wall elements extended between and connected at right angles with the relatively large portions of said duplicate walls and defining the relatively large front compartment of the chamber, one of said wall elements having a speaker aperture and the enclosure walls being otherwise substantially imperforate, and a speaker positioned within the relatively large front compartment of the chamber, the speaker being mounted on the apertured wall element and exposed for sound radiation through the aperture, and the enclosure walls being at least in large part formed of unreinforced sheet material of thickness providing for extensive participation of the enclosure in the sound generation.

4. Loudspeaker equipment as defined in claim 3 in which the opposite edges of at least the relatively small portions of each of said duplicate walls are parallel to each and define opposite edges of a rear speaker chamber compartment projecting rearwardly from the relatively large front speaker chamber compartment in the configuration of a relatively thin but wide tail.

5. Loudspeaker equipment as defined in claim 3 in which the apertured wall element of the front compartment of the speaker chamber is presented toward the front for forward sound radiation of the speaker through said aperture.

6. Loudspeaker equipment as defined in claim 4 in which the relatively small portions of each of said duplicate walls are extended rearwardly from the relatively large portions thereof in mid-region of the large portions.

7. Loudspeaker equipment as defined in claim 4 in which the relatively small portions of each of said duplicate walls are extended rearwardly from the relatively large portions thereof at one side of the large portions.

* * * * *